US005454214A

United States Patent [19]

Lancaster

[11] Patent Number: 5,454,214

[45] Date of Patent: Oct. 3, 1995

[54] AUTOMATIC VACUUM PACKAGING APPARATUS

[76] Inventor: Paul B. Lancaster, 2531 Chester La., Bakersfield, Calif. 93304

[21] Appl. No.: 146,444

[22] Filed: Oct. 27, 1993

[51] Int. Cl.[6] ..... B65B 11/52

[52] U.S. Cl. ..... 53/509

[58] Field of Search ..... 53/509, 427

[56] References Cited

U.S. PATENT DOCUMENTS

| | | | |
|---|---|---|---|
| 3,377,770 | 4/1968 | Rorer | 53/509 |
| 3,634,993 | 1/1972 | Pasco | 53/437 |
| 3,694,991 | 10/1972 | Perdue | 53/427 |
| 3,828,520 | 8/1974 | Merritt | 53/509 |
| 3,897,675 | 8/1975 | Wilson | 53/509 |
| 3,945,172 | 3/1976 | Johnson | 53/112 A |
| 3,950,919 | 4/1976 | Perdue | 53/427 |
| 4,034,536 | 7/1977 | Mahaffy | 53/112 A |
| 4,114,758 | 9/1978 | Coleman | 53/433 |
| 4,418,511 | 12/1983 | Collin | 53/427 |
| 4,420,362 | 12/1983 | Valimont | 156/563 |
| 4,480,425 | 11/1984 | Furukawa | 53/509 |
| 4,575,991 | 3/1986 | Hollingsworth | 53/509 |
| 5,069,018 | 12/1991 | Puett | 53/427 |

FOREIGN PATENT DOCUMENTS

| | | | |
|---|---|---|---|
| 2412948 | 10/1975 | Germany | 53/509 |

*Primary Examiner*—Daniel C. Crane
*Attorney, Agent, or Firm*—Mark D. Miller

[57] ABSTRACT

An automatic vacuum packaging apparatus which is defined by a closable frame having upper and lower sections, the lower section including a heatable platen configured with one of several patterns of transversing channels through which air can be evacuated through two separate conduits drawn into one vacuum chamber located beneath the lower platen. The upper section is closable over the lower section and has a separate variable heating element and separate peripheral attachment to the vacuum. Plastic sheets may be placed on the upper and lower frames, and an object placed between them. Then, through the electronically controlled interaction of the vacuum, heating elements, channels and closure of the frames the object may be vacuum sealed between the plastic sheets. The patterns of channels allow for the improved removal of air as the channels vary in length thus increasing the ability of the vacuum to efficiently remove over 97% of the air by concentrating the pull of the vacuum in smaller areas.

29 Claims, 10 Drawing Sheets

AUTOMATIC VACUUM PACKAGING APPARATUS

BACKGROUND OF THE INVENTION

1. Field of the Invention

The present invention relates generally to vacuum packaging systems. In particular, this invention relates to an improved automatic method and apparatus for the vacuum packaging of products between two sheets of plastic film through the use of transverse channels and side ventilation panels.

2. Description of the Prior Art

Vacuum packaging systems are well known in the art. Early vacuum packaging systems such as U.S. Pat. Nos. 2,778,173; 3,255,567; 3,311,517; and 3,216,172 each allow for vacuum sealing of an object sandwiched between two heated sheets of plastic material. There are drawbacks to the air evacuation methods of each of these patents since an opening in the vacuum seal is left after air is removed which opening must be separately closed by a subsequent operation. As a result, the vacuum closure can never be absolute, and there is a risk of introduction of foreign matter after the vacuum process has been completed.

A U.S. Pat. No. 2,778,173 (1957) issued to Taunton discloses a vacuum packaging method wherein two pieces of packaging film sandwiched an article therebetween. One or both of the films are placed on heated dies which create projections on the films. The object is placed between the two films with the projections facing each other. A vacuum is then drawn through an exhausting hole extending through one film and surrounded by projections, thereby removing the air between the object and the two plastic sheets. The sheets can then be heat sealed to close the exhausting hole.

U.S. Pat. Nos. 3,255,567 (1966) and 3,311,517 (1967) to Keslar et al., disclose a bag comprised of two 2-ply layers of plastic material which sandwiches the object to be sealed. The inner ply of each of the two sides of the bag is embossed with a grid of protuberances which provide grooves through which air can escape. Three sides of the bag are sealed and the object is placed between the two layers. The air is then removed through an evacuation apparatus through the open side of the bag. Once the evacuation is completed the open side is heat sealed.

The Piazze invention, U.S. Pat. No. 3,216,172 (1965) shows a method and apparatus for sealing a vacuum packaging bag. The lower side of the bag has an air evacuating opening. A stiff patch is then placed over the opening.

Refinements to the earlier patents described above are disclosed in U.S. Pat. Nos. 3,828,520 and 3,945,172. Both of these patents were based on the use of ridges on a lower platen (or preformed lower plastic sheet) which created additional channels through which is evacuated. U.S. Pat. No. 3,828,520 issued to Merritt in 1974 discloses a method of producing an airtight sealed package through the use of a lower platen with raised protuberances which allowed for the removal of air through the channels created by the protuberances. In U.S. Pat. No. 3,945,172 (1975) issued to Johnson, this method was improved upon through the use of a preformed bottom plastic sheet. The preformed bottom plastic sheet provided transverse channels through which air was drawn to assure complete exhaustion of air between the top and bottom sheets. Despite the introduction and use of the additional channels in the lower platen or sheet, these inventions only resulted in an air evacuation rate of between 50% and 60% percent.

SUMMARY OF THE INVENTION

The present invention improves on the prior art by introducing an automatic vacuum sealing apparatus having either two or four side ventilation panels through which air is evacuated thereby creating a much improved vacuum seal around an object. The present invention provides an air evacuation rate between 97–99% through the use of a minimum of 23–30 Hg of vacuum power. In one embodiment of the present invention, a special 4-sectioned platen (see FIG. 4) is provided having grooves, channels and openings therein (as well as four air troughs along its sides) which provides for extremely efficient air evacuation from around an object.

It is therefore a primary object of the present invention to provide an improved automatic vacuum packaging and sealing method and apparatus which allows for the removal of substantially all air around a packaged object by means of a bottom platen having side rail air evacuation channels which eliminate the need for a subsequent operation.

It is another important object of the present invention to provide an improved method for creating an airtight package comprised of two sheets of mutually exclusive[1] self-adhering nonporous plastic film utilizing an improved lower platen which provides for the removal of air through a bottom platen and side rail channels.

[1]The sheets will only adhere to themselves and not to any other object including the object being packaged.

Another object of the invention is to provide an improved heated vacuum platen that is capable of removing air from its upper surface as heat is applied thereto in order to deform a sheet of plastic film into the shape of the platen while also removing air from the sides of the deformed sheet in order to seal an object.

Another object of the invention is to provide an improved heated vacuum platen having a pattern of four triangular sections thereon and four corresponding air-removal troughs for efficiently removing air from within the plastic film around an object.

Another object of the invention is to provide a Programmable Logic Controller which adjusts the heat, vacuum force and timing of the sealing operation to allow for variance in these elements in order to respond to varying thicknesses of plastic employed and the size of the object sealed.

Another object of this invention is to create a superior durable, speedy and efficient automatic vacuum packaging apparatus which is not labor intensive and is simple to operate.

Other and further objects of the invention will become apparent through the following descriptions and accompanying drawings.

It has been found that the foregoing objects may be attained through the use of an automatically controlled closable frame having upper and lower sections, the lower section including a heatable platen configured with one of several patterns of transversing channels through which air can be evacuated through two separate conduits drawn into one vacuum chamber located beneath the lower platen, the upper section being closable over the lower section and having a separate variable heating means and separate peripheral attachment to the vacuum. The lower platen is comprised of a heatable pattern of ridges and openings (blades) which create channels through which air can be drawn into a chamber below the lower platen connected to a vacuum pump. The configuration of the blades allows for the improved removal of air as the channels vary in length thus increasing the ability of the vacuum to efficiently remove air by concentrating the pull of the vacuum in smaller areas. In addition to the channels created by the blades, separate side channels are also a feature of the lower platen. These side channels lead to a separate conduit through which air is also removed by means of the vacuum located beneath the lower platen. Both the upper and lower platen have their own automated heating elements.

In order to seal an object, two separate sheets of self-adhering plastic are used. The first sheet is loaded onto the underneath the movable upper mounting frame and held in place by activation of the peripheral vacuum. Thereafter, the upper heating element is activated causing the plastic to bow downwards in the middle (see FIG. 7A). A second plastic sheet is placed on the lower platen and the lower heating element is activated in order to make the second plastic sheet deformable. The lower vacuum is then activated pulling air through the holes in the lower platen, causing the second plastic sheet to deform into the pattern of the lower platen. The product to be sealed is placed on top of the deformed second plastic sheet. The upper frame is then lowered over the lower platen so that the bowed portion of the first plastic sheet comes into contact with the object being packaged. The side air channels located in the lower platen are then activated causing air to be removed through the deformed channels in the lower plastic sheet from all four sides of the lower platen. This causes the first (upper) plastic sheet to be pulled down tightly over the object. The side suction is shunted at increasing timed intervals in order to remove as much air as possible. Finally, the peripheral vacuum to the upper platen is turned off, freeing the heated first sheet of plastic so that its edges may be adhered to the edges of the second sheet of plastic. Those portions of the upper sheet of plastic which are not in contact with the object adhere to the tops of the ridges of the deformed lower sheet. As the last air is removed, the two plastic sheets adhere to each other, sealing the object between. Thereafter, all vacuum suction is turned off and the upper vacuum frame is lifted away from the lower platen revealing the product in a completely airtight plastic package.

DETAILED DESCRIPTION OF THE DRAWINGS

Figure 1:
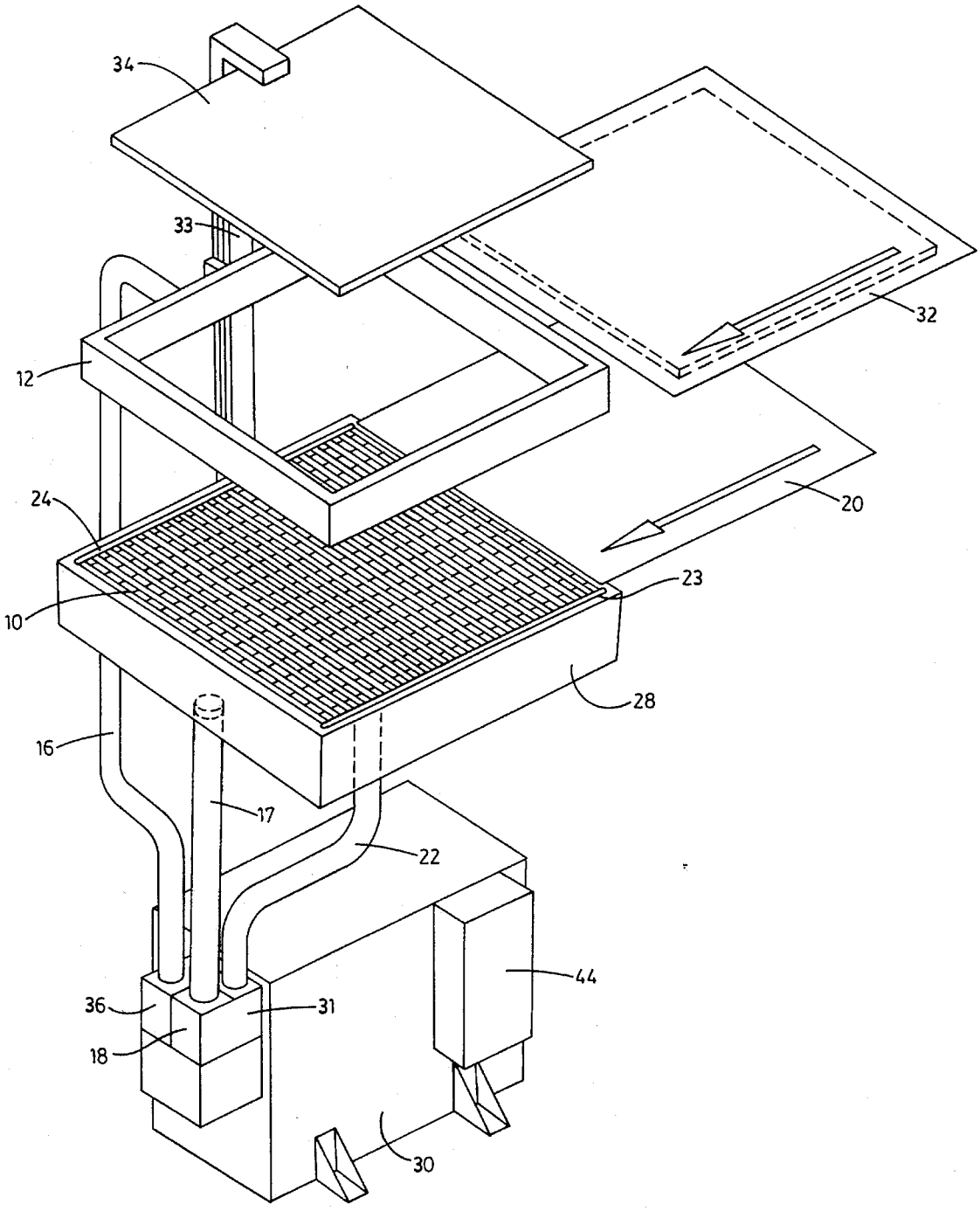
FIG. 1 is an perspective view of the present apparatus for the vacuum packaging of a product showing the upper and lower frames, the platen, and the vacuum.
Figure 3:
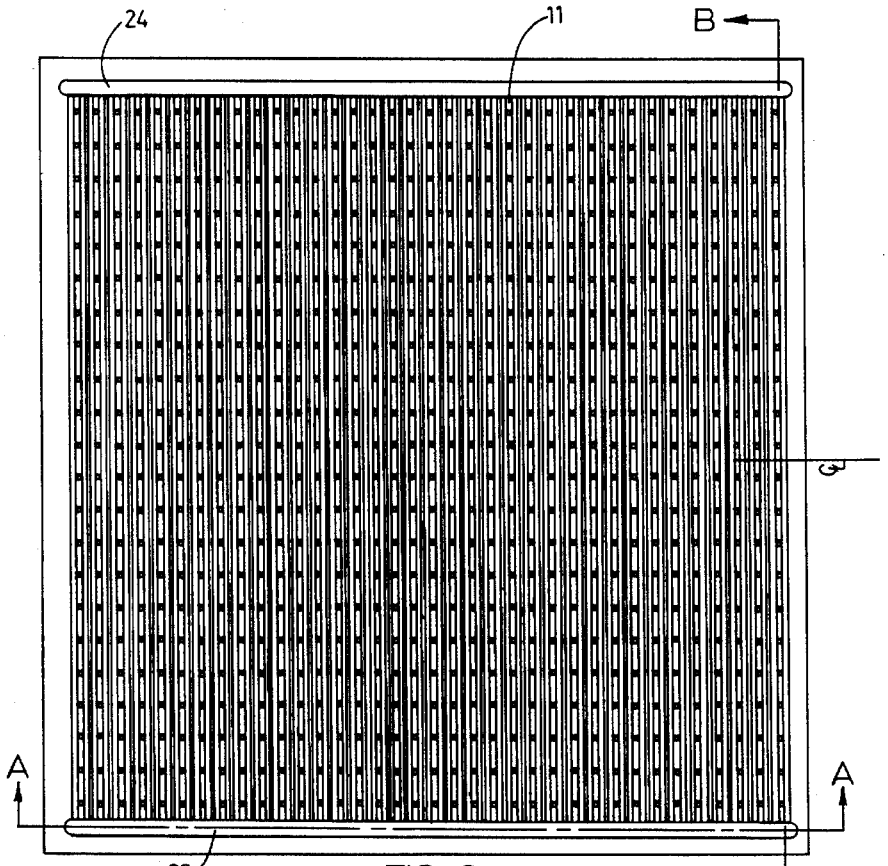
FIG. 3 is a top view of one embodiment of the lower platen.
Figure 3B:
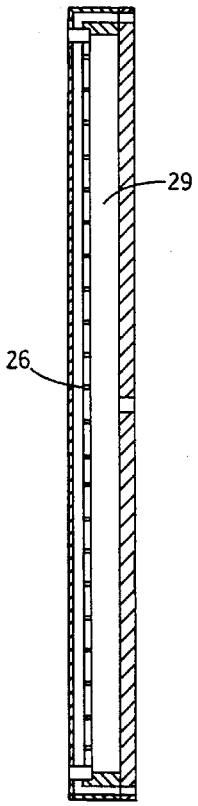
FIG. 3B is a side sectional view along lines B—B of FIG. 3 showing the side edge of the lower platen.
Figure 3A:
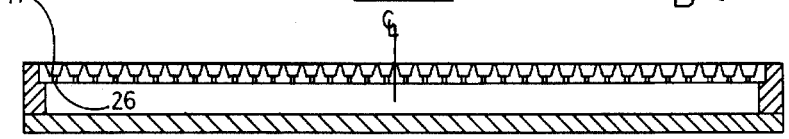
FIG. 3A is a front sectional view along lines A—A of FIG. 3 showing the front edge of the lower platen.
Figure 4:
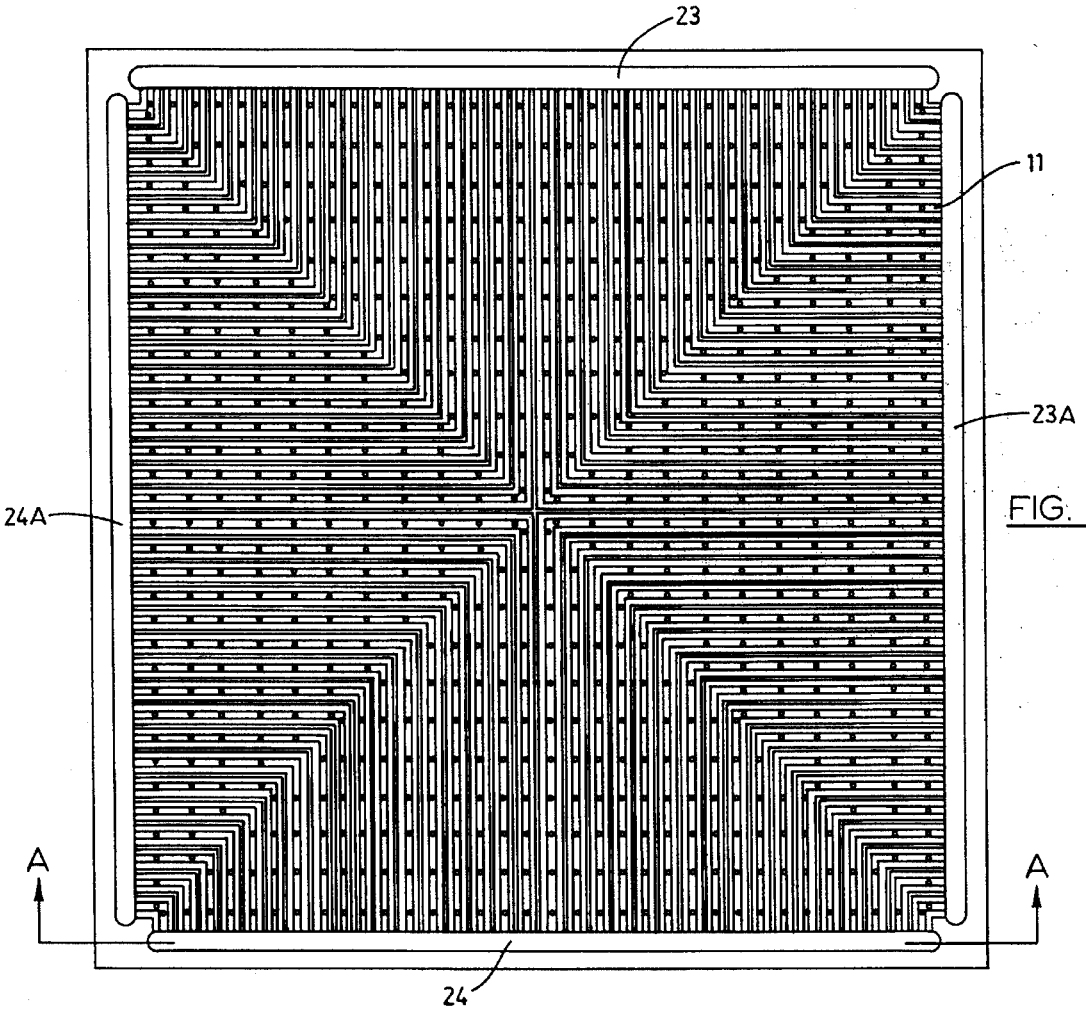
FIG. 4 is atop view illustrating an alternative (four triangular sections) structure for the lower platen shown in FIG. 3.
Figure 5:
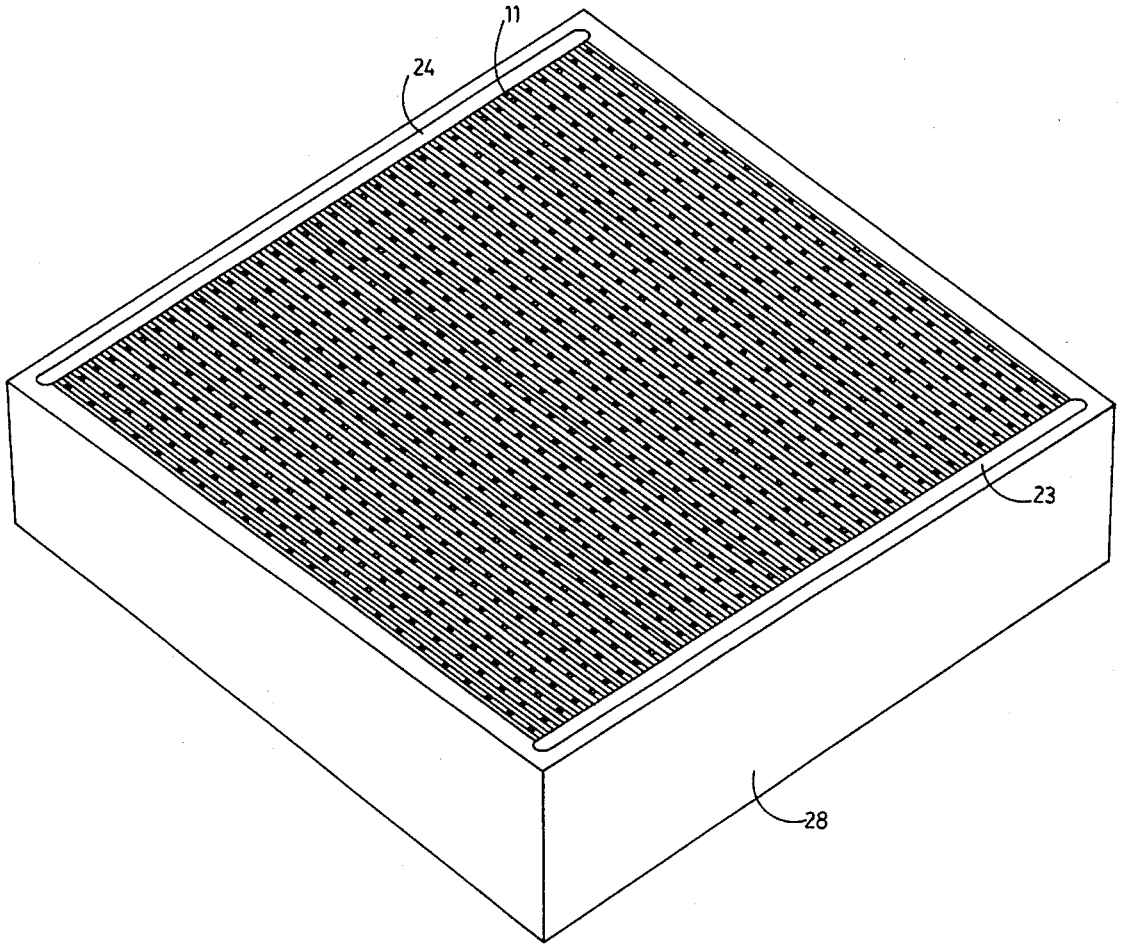
FIG. 5 is a perspective view of the lower platen shown in FIG. 3.
Figure 6:
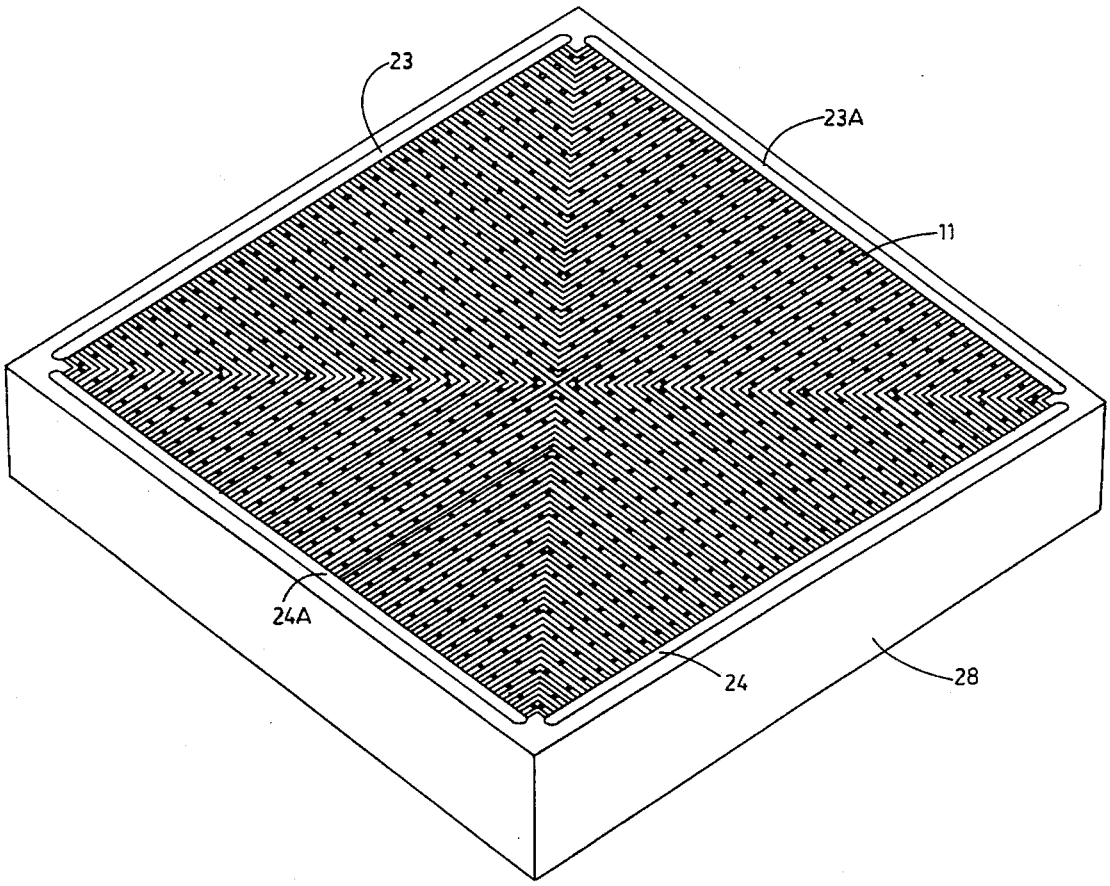
FIG. 6 is a perspective view of the lower platen shown in FIG. 4.

Referring to the drawings wherein like reference characters designate like or corresponding parts throughout the several views, and referring particularly to FIG. 1, it is seen that the invention includes a hollow overhead rectangular frame 12 attached by conduit 16 to vacuum chamber 30. A corresponding lower rectangular frame 28 is provided immediately below overhead frame 12. A heatable platen 10 is provided on said lower frame 28, one embodiment of which includes a plurality of longitudinal parallel transverse channels 11 in the shape of alternating ridges 13 and valleys which form the top surface of the lower platen (see also FIG. 3 and FIG. 5). The other platen embodiment is shown in FIGS. 4 and 6. An electronic control mechanism 44 is provided which operates apparatus by controlling the application of the vacuum, controlling the heating elements, opening and closing the frame, etc.

Figures 2A, 2B, 2C:
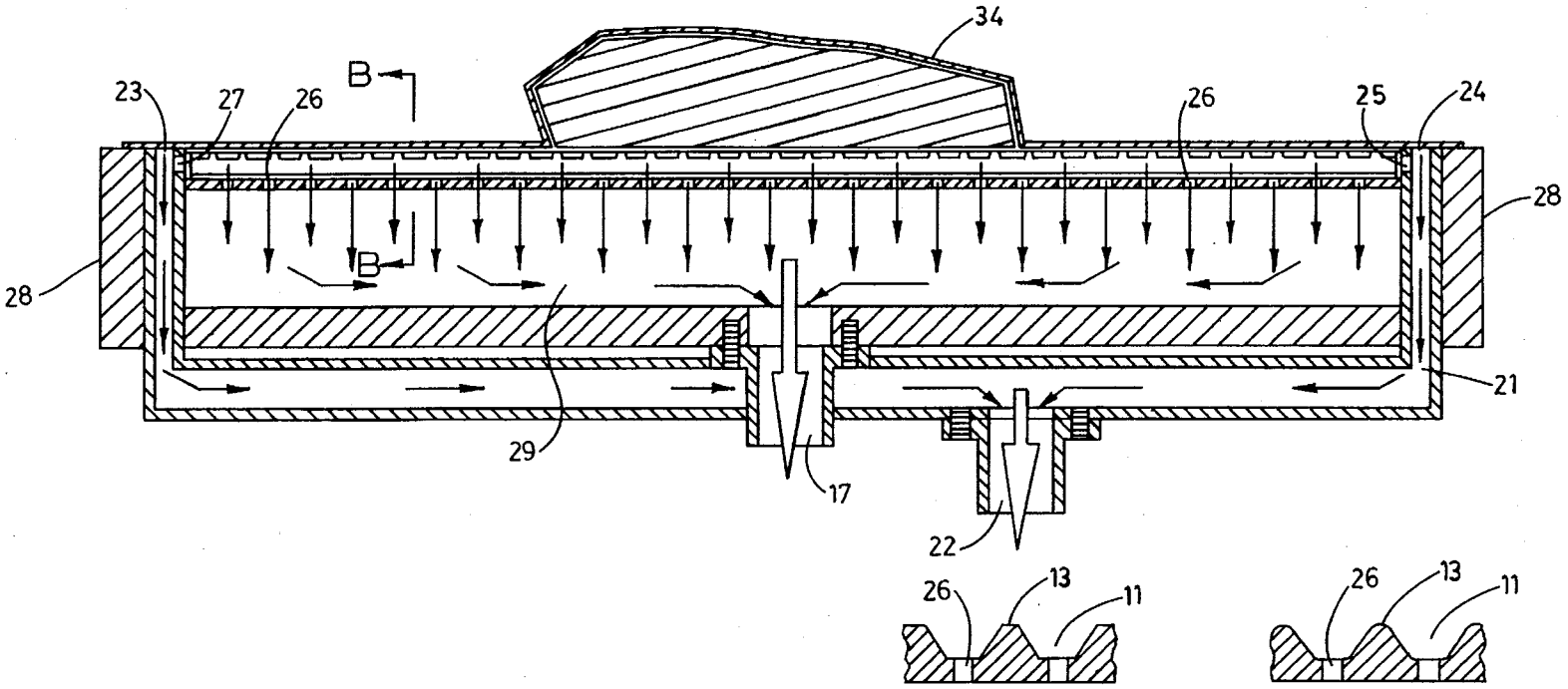
FIG. 2A is a cross-sectional view of the lower platen of the invention, showing an object sealed in plastic.
FIG. 2B is an enlarged sectional view taken in the direction of arrows B—B of FIG. 2.
FIG. 2C is an enlarged sectional view illustrating an alternative for the structure shown in FIG. 3.

A pair of troughs 23, 24 are provided on two opposite sides of lower frame 28. Channels 11 are defined by the valleys between the ridges 13, and begin at the inside edge of side trough 24 and end at the inside edge of opposite side trough 23. Each of said channels 11 includes a plurality of openings 26 in the valleys thereof along the entire length of each channel (see FIGS. 2B and 2C). These openings 26 allow vacuum conduit 17 to draw air into the collection chamber 29 directly below lower platen 10 as shown in FIG. 2A.

Side troughs 23, 24 are perpendicular to the transverse channels 11 and form a border to platen 10 through which air is drawn into the side vacuum collection chamber 21 through a separate conduit 22. Vacuum 30 provides vacuum suction to upper frame 12 through conduit 23, to platen 10 through conduit 17, and to side troughs 23 and 24 through conduit 22.

Figure 4A:
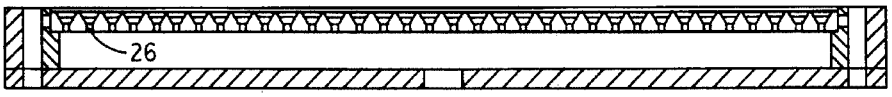
FIG. 4A is a side sectional view along lines A—A of FIG. 4 showing the side edge of the alternative embodiment of the lower platen.

An alternative four-sided embodiment of the lower platen 10 is described in FIGS. 4, 4A, and 6. This embodiment includes four troughs, one along each side, 23, 23*a*, 24 and 24*a*. The surface of the platen itself is in the shape of four triangles, the sides of which are defined by the diagonals between the opposing corners of the platen. All of the channels 11 of this embodiment include one right angle at the diagonal. The triangular shape of the four sections of this embodiment provide for a more efficient and complete removal of air through all four troughs.

Figure 7A:
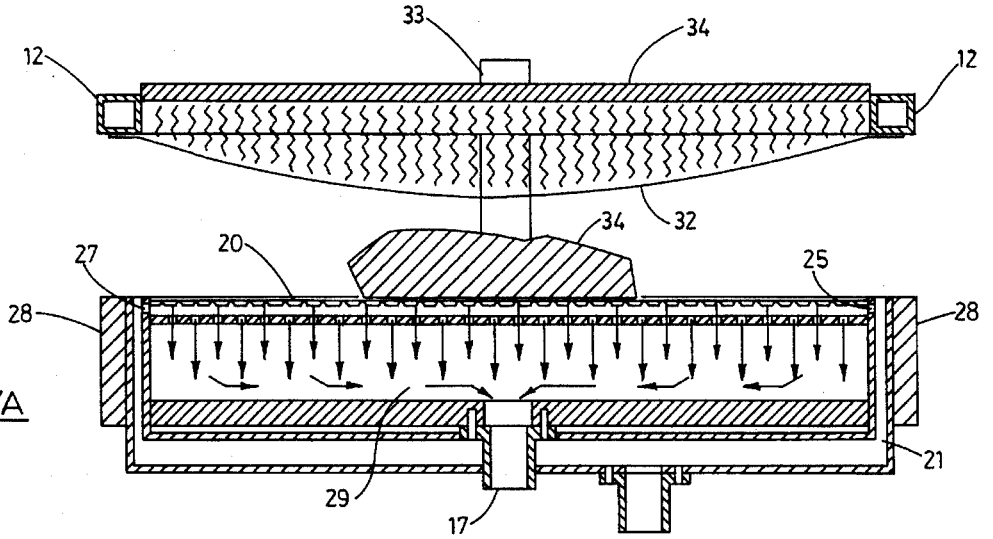
FIG. 7A is a sectional side view of the upper and lower frames of the invention before the upper frame is lowered, showing the bowing of the upper plastic sheet resulting from heat.
Figure 7B:
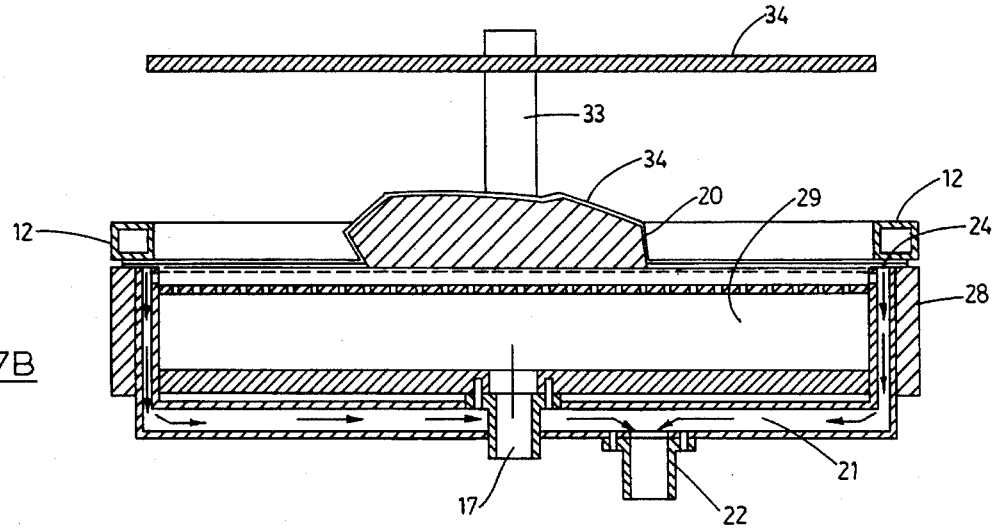
FIG. 7B is a sectional side view of the upper and lower frames of the invention after the upper frame is lowered to come into contact with the lower frame.
Figure 8:
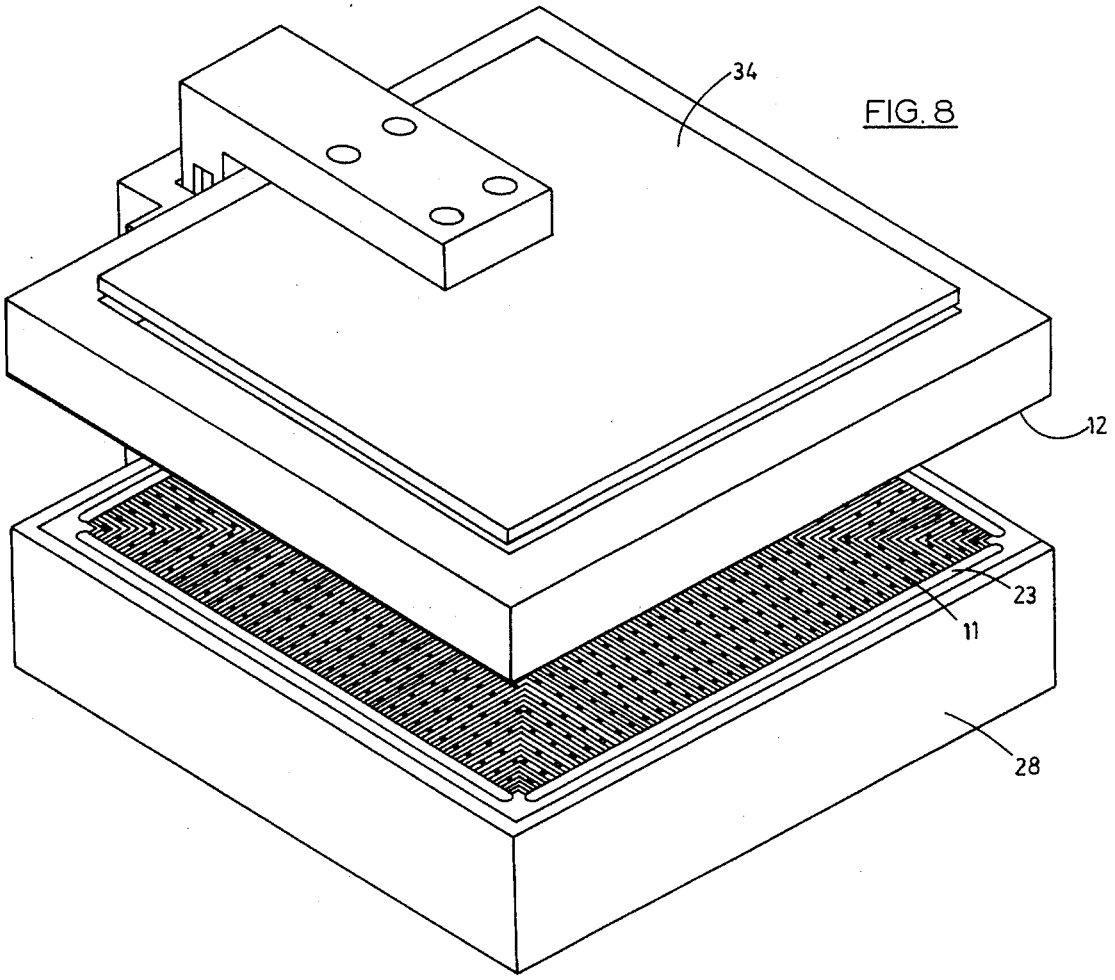
FIG. 8 is a perspective view of the invention showing the upper frame being closed over the lower frame.
Figure 9:
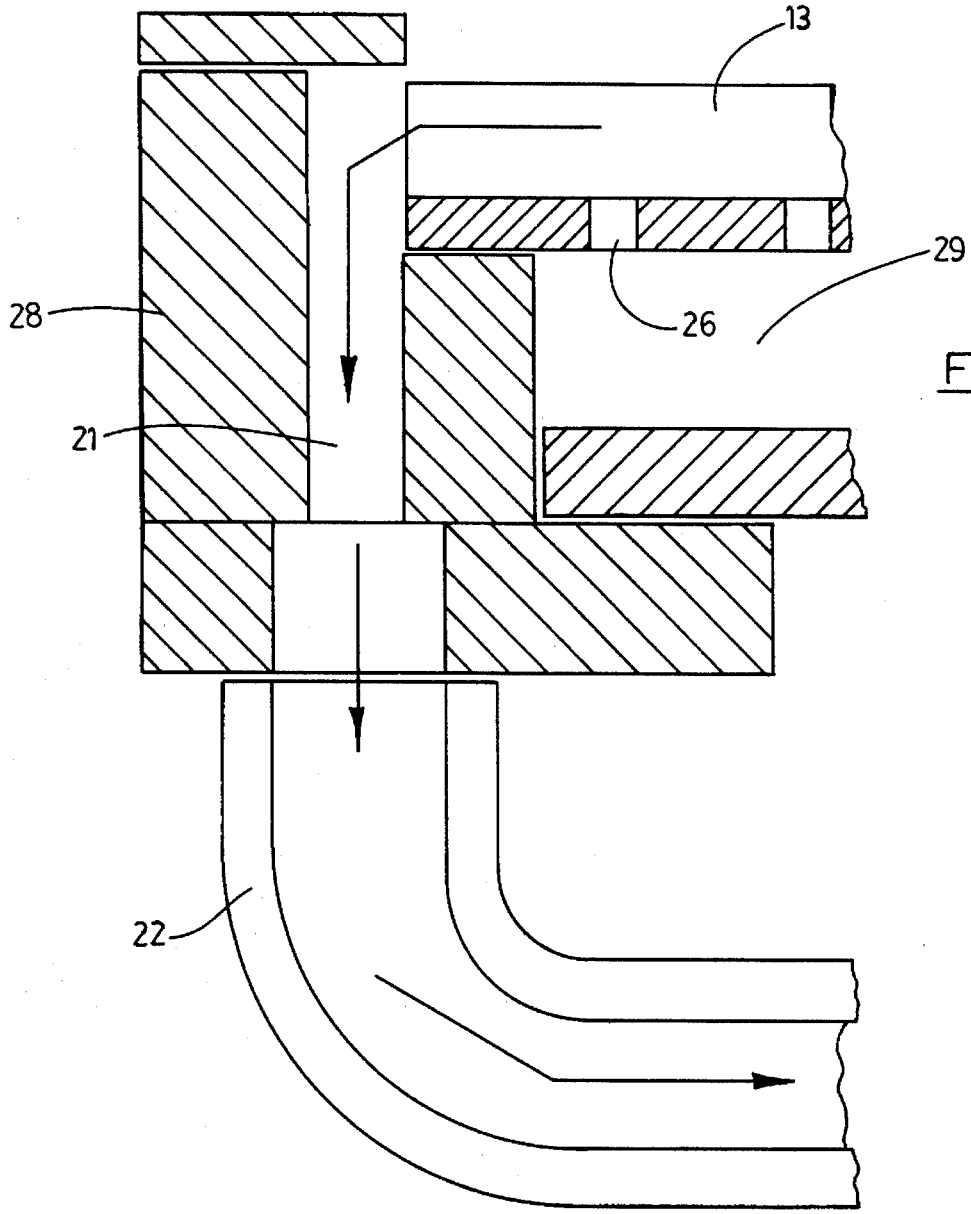
FIG. 9 is a partial side cutaway view showing air vacuum of the lower frame.
Figure 10:
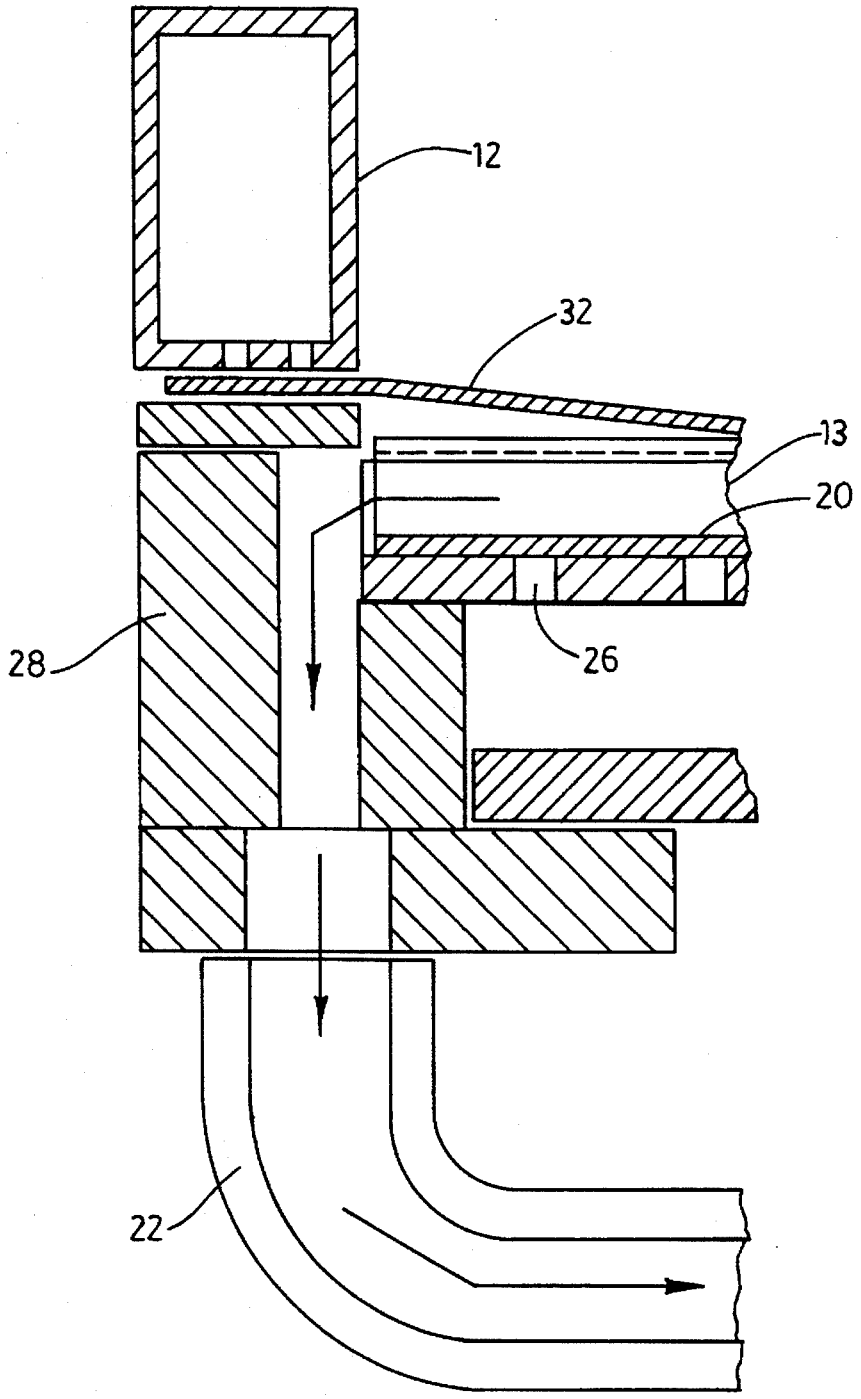
FIG. 10 is a partial side cutaway view showing air vacuums of the upper and lower frames in a closed position.

Referring now specifically to FIGS. 1, 7A and 7B, the operation of packaging an object 34 and the employment of the platens and troughs will be described. A first sheet of plastic 32 is loaded into the upper vacuum frame 12. By opening air gate 36 to conduit 16, air will be evacuated around the perimeter of sheet 32 through upper frame 12. Heating element 34 contained in upper frame 12 is then activated. At the same time, a second sheet of plastic 20 is placed on the lower platen 10, and the lower heating element (not shown) is activated. The two heating elements cause the first and second sheets of plastic, 32 and 20, to become deformable. Sheet 32 sags or bows in the middle as a result (see FIG. 7A). By opening air gate 18 to conduit 17, air will be evacuated through collection chamber 29 which in turn will pull and shape the second plastic sheet 20 through openings 26 to fit precisely against the contours of the ridges 13 and channels 11 of the lower platen 10.

The object to be sealed 33 is placed on top of deformed lower plastic sheet 20. The upper vacuum frame 12 is then lowered into position over lower frame 28 causing the first sheet 32 to come into contact with object 33. As frame 12 continues downward, air gate 31 to conduit 22 is opened causing air to be evacuated through side troughs 23 and 24 by means of side venturi 27 and 25 (see FIGS. 7A and 7B). When the upper frame has come all the way down (see FIG. 7B), air gate 18 to conduit 17 is shunted at increasing timed intervals causing the upper plastic sheet 19 to be pulled and shaped to fit precisely the contours of the object 33 and channels 11. Finally, air gate 36 to conduit 16 is closed, dislodging plastic sheet 32 from the upper frame 12, allowing the edges of the two plastic sheets 20 and 32 to adhere to each other, creating an airtight hermetically sealed package.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An apparatus for vacuum packaging an article between two sheets of plastic comprising:

a. an hollow upper rectangular frame having a heating element thereon attached through a first valve means to a vacuum source;

b. a hollow lower rectangular frame positioned below said upper frame and attached through a second valve means to said vacuum source whereby said upper frame may be lowered onto said lower frame;

c. a rectangular platen positioned on said lower frame having a heating element therein and attached through a third valve means to said vacuum source, said platen having a plurality of transversing channels made up of alternating ridges and troughs, each such channel having a plurality of holes therein so that air may be drawn into said vacuum from beneath the platen; and d. electronic circuitry for controlling said frame, vacuum, valve and heating elements;

whereby a first plastic sheet may be attached by said vacuum to the under side of said upper frame, a second plastic sheet may be placed on said platen and an object placed upon said second sheet so that by selectively activating the heating elements, valve means and the vacuums in conjunction with closing said upper frame over said lower frame, an object may be sealed between said plastic sheets.

2. The apparatus described in claim 1 above wherein a means for lowering the upper vacuum frame over the lower platen is provided whereby the upper plastic sheet comes in contact with the object being packaged and the edges of the upper plastic film come into contact with the edges of the lower plastic sheet.

3. The apparatus described in claim 2 above wherein said platen is provided with no more than four side rail channels, each such channel attached to the ends of said transversing channels and leading to said vacuum so that air may be drawn from the sides of the article and between the two sheets of plastic.

4. The apparatus described in claim 3 above wherein the surface said platen is in the shape of four triangles, the sides of which are defined by the diagonals between the opposing corners of the platen, each such channel including one right angle at the diagonal.

5. The apparatus described in claim 4 above wherein three separate conduits are provided, each of which is separately connected between the vacuum source and, respectively, the upper vacuum frame, the lower vacuum frame and the lower platen so that air can be evacuated from these various areas at different times and in different intervals.

6. The apparatus described in claim 5 above wherein an automated means is provided for heating the upper frame so as to control the amount and timing of heat applied to the upper plastic sheet.

7. The apparatus described in claim 6 above wherein an automated means is provided for heating the lower platen so as to control the amount and timing of heat applied to the lower plastic sheet.

8. The apparatus described in claim 7 above wherein an automated means is provided for activating the vacuum through the lower conduit to draw the lower plastic sheet directly against the lower platen.

9. The apparatus described in claim 7 above wherein a means for activating the vacuum to the side troughs is provided in order to exhaust air from around the object and from between the top and bottom sheets of plastic, thereby providing an airtight seal around the object.

10. An automatic vacuum packaging device comprising:

a. an upper rectangular frame having a heating element therein, said frame being connected through a first air gate to an air evacuation means;

b. a lower rectangular frame corresponding to said upper frame, said lower frame having a pair of oppositely positioned edge openings therein, said edge openings being connected through a second air gate to said air evacuation means;

c. means for raising and lowering said upper frame against and away from said lower frame;

d. a platen mounted in said lower frame having a heating element therein, said platen comprising a plurality of channels made up of alternating ridges and troughs, each such trough including a plurality of openings therein along the length of such trough, said openings being connected through a third air gate to said air evacuation means; and h. electronic circuitry for controlling said frame, air gates, air evacuation means and heating elements.

11. The apparatus described in claim 10 above wherein a first plastic sheet is attached using said air evacuation means to the under side of said upper frame, a second plastic sheet is placed on said platen and an object is placed upon said second sheet so that by controlling the heating elements and the air evacuation means in conjunction with closing said upper frame over said lower frame, an object may be sealed between said plastic sheets.

12. The apparatus described in claim 11 above wherein a means for lowering the upper vacuum frame over the lower platen is provided whereby the upper plastic sheet comes in contact with the object being packaged and the edges of the upper plastic film come into contact with the edges of the lower plastic sheet.

13. The apparatus described in claim 11 above wherein said lower frame is provided with no more than four edge openings, the ends of each channel in the lower platen being attached to one of said edge openings which openings lead to said air evacuation means so that air may be drawn from the sides of the article and between the two sheets of plastic.

14. The apparatus described in claim 13 above wherein the channels making up the surface said platen are in the shape of a flat pyramid made up of four connected triangles, the sides of which are defined by the diagonals between the opposing corners of the platen and the four edge openings of the platen, each such channel including one right angle at the diagonal.

15. The apparatus described in claim 11 above wherein three separate conduits are provided, each of which is connected through a separate valve means between the vacuum source and, respectively, the upper vacuum frame, the lower vacuum frame and the lower platen so that air can be evacuated from these various areas at different times and in different intervals.

16. An automatic packaging device for sealing an object between two plastic sheets comprising:

a. an upper rectangular frame for receiving a first sheet of plastic material, said frame having a heating element therein and being attached through a first air gate to an air evacuation means;

b. a lower rectangular frame corresponding to said upper frame, said lower frame being attached through a second air gate to said air evacuation means;

c. a platen mounted in said lower frame for receiving a second sheet of plastic material, said platen having a heating element therein and a plurality of channels made up of alternating ridges and troughs on the surface thereof, each such channel having a plurality of openings along its length, said openings being attached through a third air gate to said air evacuation means;

d. a means for lowering and raising said upper frame against and away from said lower frame; and e. electronic circuitry for controlling said frame, air evacuation means, air gates and heating elements in order to seal an object between said plastic sheets.

17. The device described in claim 16 above wherein a pair of oppositely positioned edge openings are provided in said lower frame surrounding said platen, said edge openings being connected through said second air gate to said air evacuation means.

18. The device described in claim 16 above wherein no less than four edge openings are provided in said lower frame surrounding said platen, said edge openings being connected through said second air gate to said air evacuation means.

19. The device described in claim 16 above wherein the channels on the surface of said platen are in the form of a series of parallel ridges and troughs.

20. The device described in claim 17 above wherein the channels on the surface of said platen are in the form of a series of parallel ridges and troughs.

21. The device described in claim 16 above wherein the channels on the surface of said platen are angled along the diagonals between the opposing corners of the platen in a flat pyramid-like pattern.

22. The device described in claim 18 above wherein the channels on the surface of said platen are angled along the diagonals between the opposing corners of the platen in a flat pyramid-like pattern.

23. The apparatus described in claim 16 above wherein three separate conduits are provided, each of which is separately connected between said air evacuation means and, respectively, the upper frame, the lower frame and the platen so that air can be evacuated from these various areas at different times and in different intervals.

24. The apparatus described in claim 16 above wherein an automated means is provided for heating the upper frame so as to control the amount and timing of heat applied to the first plastic sheet.

25. The apparatus described in claim 24 above wherein an automated means is provided for heating the platen so as to control the amount and timing of heat applied to the lower plastic sheet.

26. The apparatus described in claim 16 above wherein an automated means is provided for activating the air gate to the upper frame to hold the first plastic sheet in place against said frame.

27. The apparatus described in claim 26 above wherein an automated means is provided for activating the air gate to the platen to draw the second plastic sheet directly against the platen.

28. The apparatus described in claim 27 above wherein a means is provided for activating the air gate to the lower frame in order to exhaust air from around the object and from between the two sheets of plastic, thereby providing an airtight seal around the object.

29. An automatic vacuum packaging device comprising:

a. an upper rectangular frame having a heating element therein said frame being connected to an air evacuation means;

b. a lower rectangular frame corresponding to said upper frame, said lower frame also having a separate heating element therein and being separately connected to said air evacuation means;

c. means for raising and lowering said upper frame against and away from said lower frame;

d. a platen mounted in said lower frame, said platen comprising a plurality of parallel channels made up of alternating ridges and troughs, each such trough including a plurality of openings therein along the length of such trough;

e. means for connecting said plurality of trough openings to said air evacuation means;

f. a pair of oppositely positioned edge openings in said lower frame surrounding said lower platen;

g. means for connecting said edge openings to said air evacuation means; and h. electronic circuitry for controlling said frame, air evacuation means and heating elements;

wherein three separate conduits are provided, each of which is connected through a separate valve means between the vacuum source and, respectively, the upper vacuum frame, the lower vacuum frame and the lower platen so that air can be evacuated from these various areas at different times and in different intervals, allowing a first plastic sheet to be attached to the under side of said upper frame, a second plastic sheet to be placed on said platen and an object to be placed upon said second sheet so that by controlling the heating elements and the air evacuation means in conjunction with closing said upper frame over said lower frame, an object may be sealed between said plastic sheets.

* * * * *